US005638583A

United States Patent [19]

Tseng

[11] Patent Number: 5,638,583

[45] Date of Patent: Jun. 17, 1997

[54] PAPER CLIP

[76] Inventor: E-San Tseng, P.O. Box 90, Tainan 704, Taiwan

[21] Appl. No.: 580,899

[22] Filed: Dec. 29, 1995

[51] Int. Cl.[6] ..... A44B 21/00; A44B 11/25

[52] U.S. Cl. ..... 24/67.5; 24/67.3; 24/563; 24/499

[58] Field of Search ..... 24/67.5, 67.3, 24/530, 67.9, 499, 459, 545, 557, 565, 563

[56] References Cited

U.S. PATENT DOCUMENTS

| | | | |
|---|---|---|---|
| 2,019,036 | 10/1935 | Ashbridge | 24/563 X |
| 2,092,522 | 9/1937 | Post | 24/565 X |
| 2,183,730 | 12/1939 | Vander Clute | 24/545 |
| 3,213,509 | 10/1965 | Reiner | 24/499 |
| 3,324,864 | 6/1967 | Triangolo | 24/499 X |
| 5,361,463 | 11/1994 | Revis | 24/499 X |

FOREIGN PATENT DOCUMENTS

| | | | |
|---|---|---|---|
| 19567 | 5/1996 | United Kingdom | 24/565 |

*Primary Examiner*—Peter M. Cuomo
*Assistant Examiner*—Hanh V. Tran

[57] ABSTRACT

A paper clip consists of two elastic steel plates only, and each elastic steel plate has a connect member punched out of its upper portion, and an upper curved grip is formed therein after punching. The two connect members are bent inward and combined together by hooking their outer ends together, with lower ends of the two steel plates elastically and separably contacting with each other for gripping papers by pressing inward and then releasing the curved grips.

2 Claims, 7 Drawing Sheets

PAPER CLIP

BACKGROUND OF THE INVENTION

This invention concerns a paper clip, particularly formed of two elastic steel plates combined together by means of two connect members punched out of two steel plates and hooking or engaging the members with each other.

A known conventional paper clip shown in FIG. 1 has a clip body 10 of a triangular cross-section and two press grips 14, 14 formed of steel wire combined together. The clip body 10 includes a lip 11, and two curled members 12, 13 formed along the lip 11. Two ends of each press grip 14 are held in the curled members 12, 13 so that the lip may be opened by pressing two press grips 14, 14 inward for papers to be inserted therein and pinched by releasing [he two press grips 14, 14.

However, the known conventional paper clip has disadvantages as listed below.

1. Assembling the two press grips with the clip body is not easy, as the end sections of the grips have to be pressed inward to be inserted in the curled members 12, 13, causing some danger and requiring force.

2. In storing the press grips, they may hook with one another, and it may take time to unhook them in case of assembling, lowering thereby effectiveness.

SUMMARY OF THE INVENTION

An object of the present invention is to offer a kind of paper clip, which is easy and quick in assembling, and can reduce cost in production.

A main feature of a first preferred embodiment of the present invention is two elastic steel plates as the only material, each of which is are respectively punched out to form a connect member in an upper portion thereof. The two connect members are bent down inward a little more than 90 degree, respectively having an outer end bent as a hook to hook with each other so as to assemble the two elastic steel plates into a paper clip. And a curved press grip is formed in an upper end section after the connect member is punched out.

A main feature of a second preferred embodiment of the present invention is two elastic steel plates as the only material as the first embodiment. The two elastic steel plates are respectively punched out a connect member bent down a little more than 90 degree. A first connect member has a slot extending inward in its outer end section, several continuous sloped faces and vertical faces between two sloped faces are respectively formed in both sides of the outer end section. A second connect member has a passageway formed under the outer end section for the outer end section of the first connect member to engage therein by means of one of the vertical face engage with an outer end face of the second connect member.

A main feature of a third preferred embodiment of the present invention is two elastic steel plates as the only material, which are respectively punched out a connect member bent down a little more than 90 degree. A first connect member has a round hole, and a second connect member has a tubular short projection extending down from a round edge of a round hole, and the tubular short projection is inserted down through the round hole of the first connect member and pressed against a lower surface of the first connect member to assemble the two connect members and thus the two elastic steel members together.

BRIEF DESCRIPTION OF DRAWINGS

This invention will be better understood by reference to the accompanying drawings, wherein.

DESCRIPTION OF THE PREFERRED EMBODIMENTS

Figure 1:
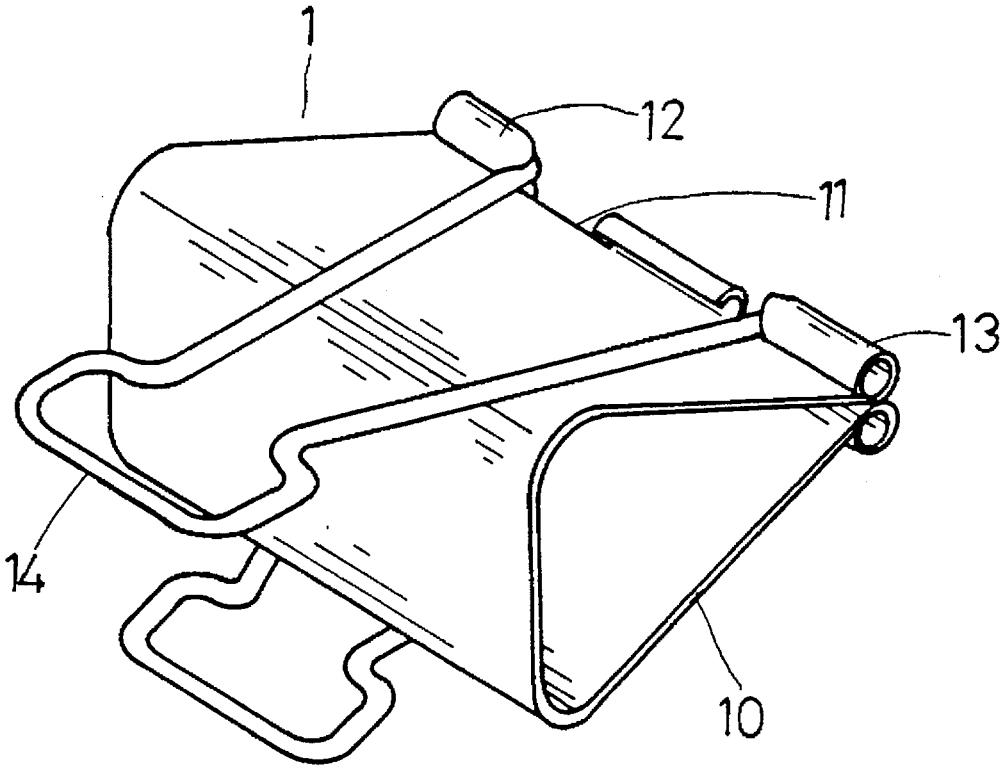
FIG. 1 is a perspective view of a known conventional paper clip.
Figure 2:
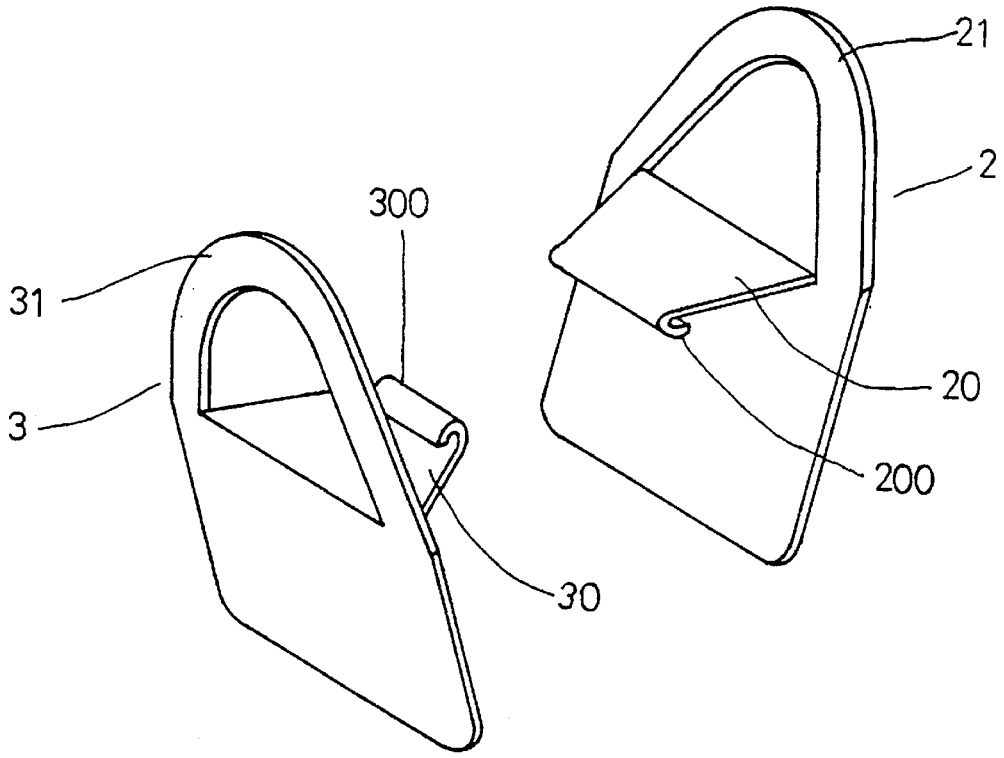
FIG. 2 is an exploded perspective view of a first preferred embodiment of a paper clip in the present invention.

A first preferred embodiment of a paper clip in the present invention, as shown in FIG. 2, includes two elastic steel plates 2, 3, from which two connect members 20, 30 are punched out of an upper portion, bent down inward a little more than 90 degree. A first connect member 20 has its outer end 200 bend down and a second connect member 30 has its outer end bent upward. The elastic steel plates 2, 3 have their upper portions formed as curved grips 21, 31 after the connect members 20, 30 are punched out.

Figure 3:
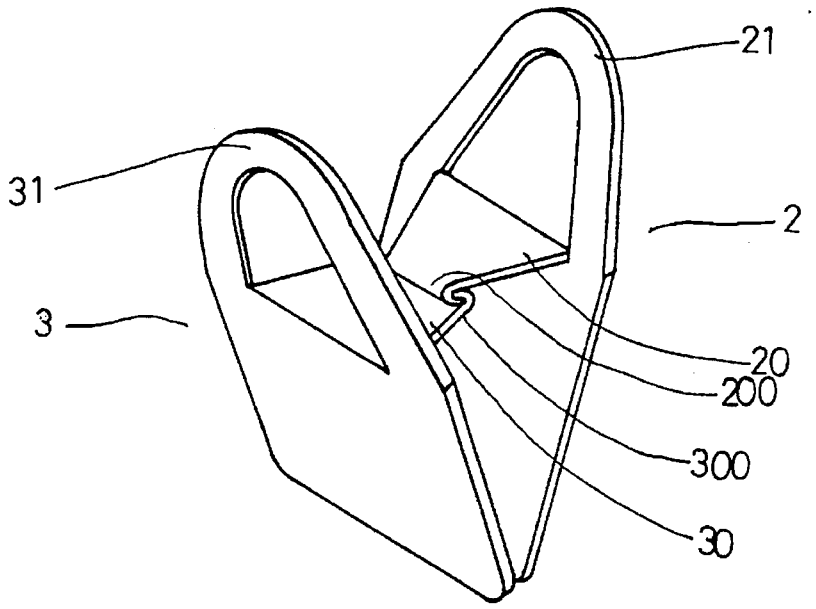
FIG. 3 is a perspective view of the first preferred embodiment of a paper clip in the present invention.
Figure 4:
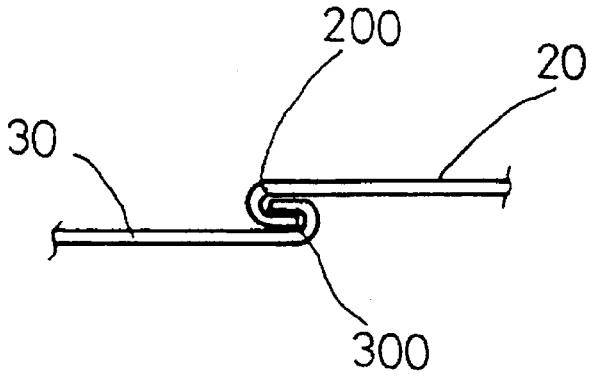
FIG. 4 is a side view of two connect plates connected with each other in the first preferred embodiment of a paper clip in the present invention.
Figure 5:
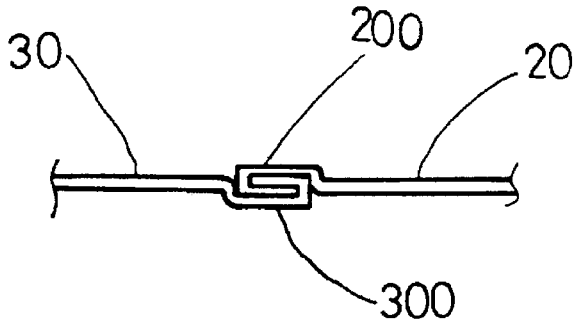
FIG. 5 is a side view of the two connect plates shown in FIG. 4 being further compressed tightly.

In assembling, referring to FIGS. 3, 4 and 5, the two bent ends 200, 300 of the two connect members 20, 30 are made to hook with each other, and then pressed tightly against each other. Thus the two elastic steel plates 2, 3 are assembled together firmly, with their lower ends contacting elastically and separably with each other.

Figure 6:
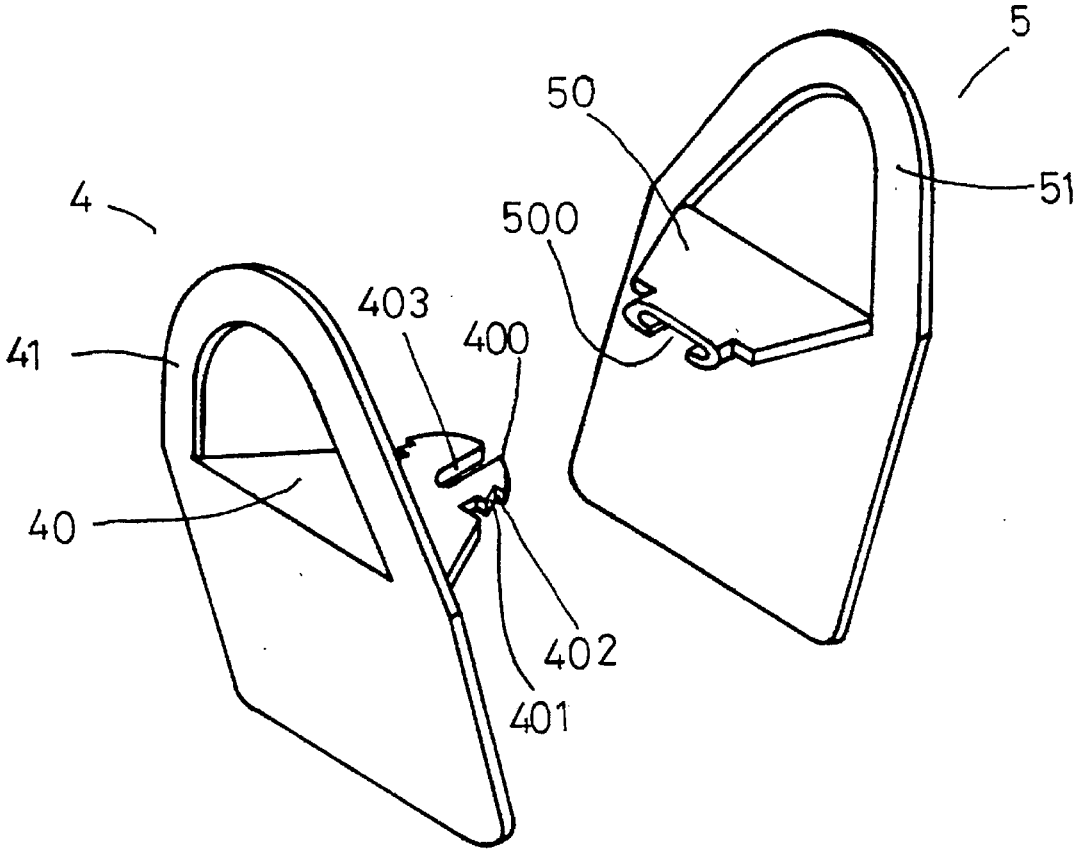
FIG. 6 is an exploded perspective view of a second preferred embodiment of a paper clip in the present invention.

A second preferred embodiment of a paper clip in the present invention, as shown in FIG. 6, includes two elastic steel plates 4, 5, from which two connect members 40, 50 punched out of upper portions and bent down inward a little more than 90 degree. A first connect member 40 has its outer end section formed into a tab member 400 having several continuous sloped faces 401 and a vertical stop face 402 between two sloped faces at both sides of the tab member 400, and a slot 403 extending straight inward from an outer edge. A second connect member 50 has a center passageway 500 half open under its end for the tab member 400 to fit tightly therein. Two curved grips 41, 51 are formed in upper end sections of the two elastic steel plates 4, 5 after the two connect members 40, 50 are punched out.

Figure 7:
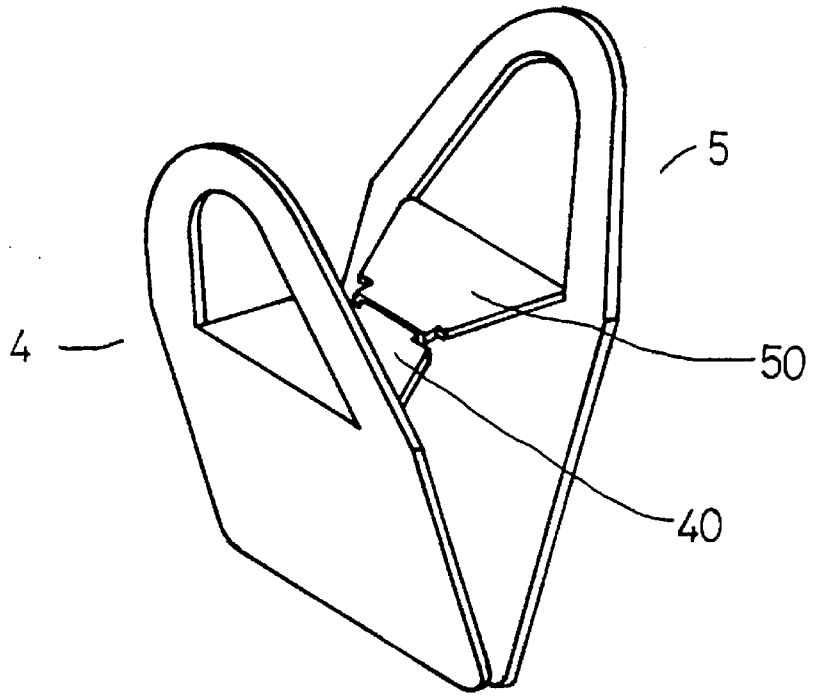
FIG. 7 is a perspective view of the second preferred embodiment of a paper clip in the present invention.
Figure 8:
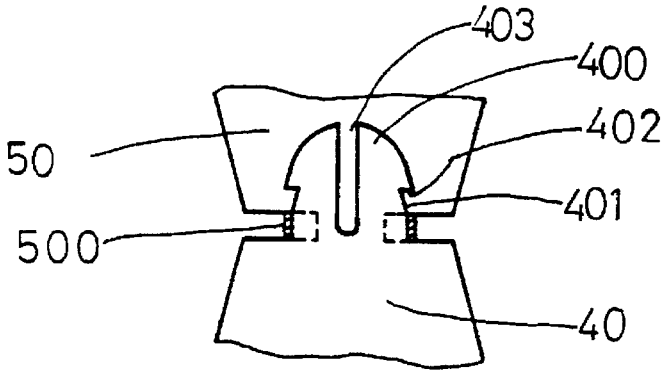
FIG. 8 is a cross-sectional view of the connect members of the two connect plates of the second preferred embodiment of a paper clip in the present invention.

In assembling the second preferred embodiment of a paper clip, referring to FIGS. 7 and 8, the tab member 400 of the first connect member 40 of the elastic steel plate 4 is fitted in the center passageway 500 of the second connect member 50 of the other elastic steel plate 5, with both sides of the tab member 400 compressed inward with elasticity formed by the center slot 403 and then with a pair of the vertical faces 401 engaging with outer end surface of the second connect member 5, keeping the two elastic steel plates 4, 5 assembled securely, with lower ends of the steel plates 4, 5 firmly, elastically and separably contacting with each other.

Figure 9:
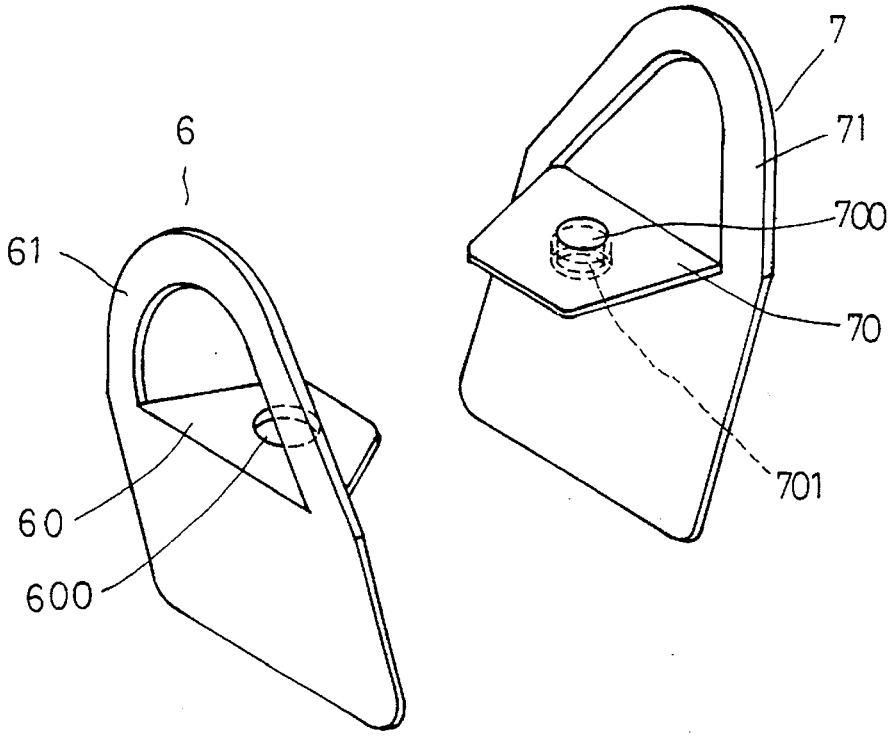
FIG. 9 is an exploded perspective view of a third preferred embodiment of a paper clip in the present invention.

A third preferred embodiment of a paper clip, as shown in FIG. 9, includes two elastic steel plates 6, 7, from which first and second connect members 60, 70 punched out and bent down inward a little more than 90. The first connect member 60 has a round hole 600 in the center portion, and the second connect member 70 has a round hole 700 in the corresponding location of the round hole 600, and a tubular short projection 701 extending down from a bottom round edge of the hole 700. The tubular projection 701 has a diameter a little smaller than that of the round hole 600. Further, the two elastic steel plates 6, 7 have curved grips 61, 71 formed after the connect members 60, 70 are punched out.

Figure 10:
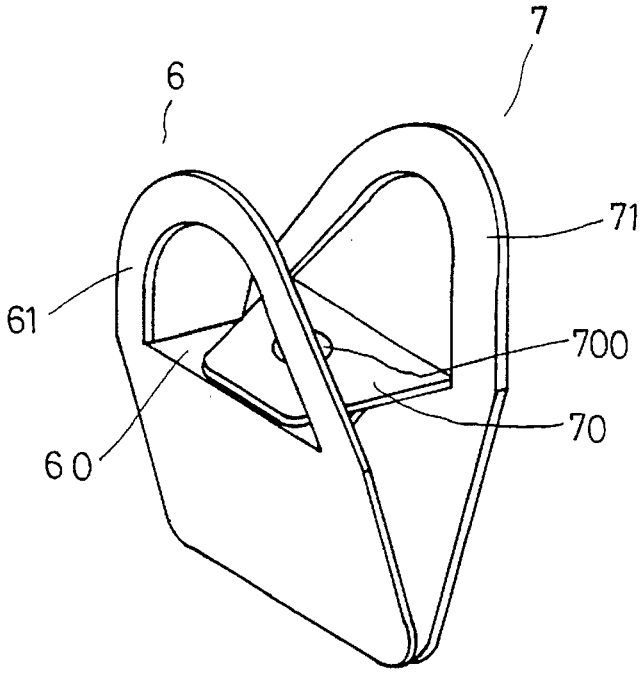
FIG. 10 is a perspective view of the third preferred embodiment of a paper clip in the present invention.
Figure 11:
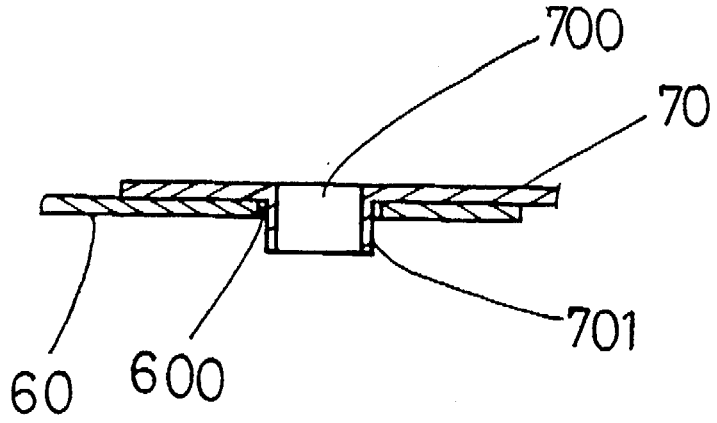
FIG. 11 is a cross-sectional view of two connect members in the third preferred embodiment of a paper clip in the present invention, showing a first step of their combination.
Figure 12:
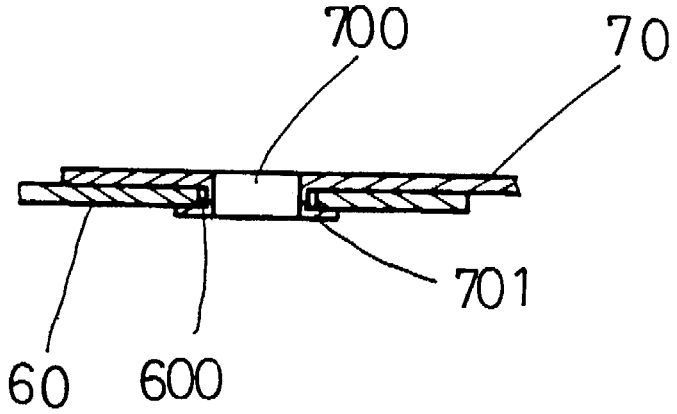
FIG. 12 is a cross-sectional view of two connect members in the third preferred embodiment of a paper clip in the present invention, showing a second step of their combination.

In assembling the third preferred embodiment of a paper clip, referring to FIGS. 10, 11, and 12, the tubular projection 701 of the second connect member 70 is just fitted through in the round hole 600 of the first connect member 60, and the tubular projection 701 is pressed or flanged outwardly to engage firmly on the lower surface of the first connect member 60. Then the two steel plates 6, 7 are assembled firmly together, with their lower ends in contact with each other elastically and separably.

The three preferred embodiments of a paper clip each have the following merits, as can be understood from the above description.

1. It is composed of only two elastic steel plates having no other components and a simple structure suitable for mass production.

2. Assembling of the two steel plates can be easily performed in a very short time and with easiness.

While the preferred embodiments of the invention have been described above, it is recognized and understood that various modifications may be made therein and the appended claims are intended to cover all such modifications, which may fall within the spirit and scope of the invention.

What is claimed is:

1. A paper clip comprising first and second elastic steel plates, each of said elastic steel plates having an upper portion punched out to form first and second connect members, and first and second curved grips, each of said elastic steel plates also having a lower end, each of said first and second connect members being bent downwardly slightly more than ninety degrees from said steel plates; wherein the first connect member having an outer end portion with two side edges and a tip edge, several sloped faces and stop faces formed along said side edges, and a slot extending inwardly from said tip edge toward the center of the first connect member, said second connect member having an outer end portion with two side edges being bent downwardly and then inwardly to form a passage way for receiving the outer end portion of said first connect member; wherein a pair of said stop faces engaging an end edge of the passage way so as to assemble said steel plates together with their lower ends in separable contact with each other defining a first position; said first and second curved grips are compressible inwardly to force the lower ends to be separated from each other, defining a second position, for papers to be inserted into a gap formed between said lower ends and pinched therein when said curved grips are released and with said lower ends recovering to said first position.

2. A paper dip comprising first and second elastic steel plates, each of said elastic steel plates having an upper portion punched out to form first and second connect members, and first and second curved grips, each of said elastic steel plates also having a lower end, each of said first and second connect members being bent downwardly slightly more than ninety degrees from said steel plates; wherein said first connect member having a first circular aperture in the center portion, and said second connect member having a second circular aperture with a rim, a tubular projection protruding from the rim of the second circular aperture for fitting through the first circular aperture, said tubular projection is then pressed outwardly to form a rivet connection between the first and second connect members, so as to assemble said steel plates together with their lower ends in separable contact with each other defining a first position; said first and second curved grips are compressible inwardly to force the lower ends to be separated from each other, defining a second position, for papers to be inserted into a gap formed between said lower ends and pinched therein when said curved grips are released and with said lower ends recovering to said first position.

* * * * *